US009009864B1

(12) United States Patent
Loveday

(10) Patent No.: US 9,009,864 B1
(45) Date of Patent: Apr. 21, 2015

(54) SYSTEM AND METHOD FOR A HYDRATION GARMENT

(71) Applicant: Douglas Elliot Loveday, Tucson, AZ (US)

(72) Inventor: Douglas Elliot Loveday, Tucson, AZ (US)

( * ) Notice: Subject to any disclaimer, the term of this patent is extended or adjusted under 35 U.S.C. 154(b) by 0 days.

(21) Appl. No.: 13/774,671

(22) Filed: Feb. 22, 2013

(51) Int. Cl.
*A41D 13/00* (2006.01)
*A41D 27/00* (2006.01)

(52) U.S. Cl.
CPC ..... *A41D 27/00* (2013.01)

(58) Field of Classification Search
USPC ..... 2/69, 94, 102, 79, 227, 238, 247, 250; 224/148.4
See application file for complete search history.

(56) References Cited

U.S. PATENT DOCUMENTS 4,564,957 A * 1/1986 Scharf ..... 2/75
5,730,339 A * 3/1998 Stolfo ..... 224/148.6
5,890,809 A * 4/1999 Nelson ..... 383/40
5,909,802 A * 6/1999 Puco et al. ..... 2/102
5,941,434 A * 8/1999 Green ..... 224/250
5,960,471 A * 10/1999 Burton ..... 2/48
6,000,664 A * 12/1999 Hood ..... 248/102
6,004,033 A 12/1999 Cirone
6,182,872 B1 * 2/2001 Six ..... 224/148.5
6,626,733 B1 * 9/2003 Knutson ..... 450/89
6,662,985 B2 * 12/2003 Harada et al. ..... 224/661
6,859,943 B1 * 3/2005 Wallace, III ..... 2/228
7,000,255 B1 * 2/2006 Baacke ..... 2/94
7,058,987 B2 6/2006 Salazar
7,201,299 B2 * 4/2007 Forsman ..... 224/148.2
7,845,506 B2 * 12/2010 Willows et al. ..... 215/382
8,316,469 B2 * 11/2012 Miller ..... 2/227
2005/0109803 A1 5/2005 Shin
2007/0083984 A1 4/2007 Wagenknecht et al.
2008/0216212 A1 9/2008 Burgess et al.

* cited by examiner

*Primary Examiner* — Tejash Patel
(74) *Attorney, Agent, or Firm* — Lisa Foundation Patent Law Clinic

(57) ABSTRACT

This invention is a hydration support garment that is sewn onto the rear of a pair of athletic pants or shorts. The hydration support garment is comprised of a cylindrical receptacle sewn onto the aforementioned athletic apparel that is configured to house a water bottle. In some applications of the invention, the receptacle will further include a mesh base for support. Some implementations further include an elastic strap that secures the top of the water bottle. Finally, the invention may also contain optional pockets or key-holder attachments. The invention is designed to provide hands-free access to a hydration source in such a way to allow the user of the invention to exercise without manually carrying a water bottle when hydration is unnecessary.

20 Claims, 3 Drawing Sheets

SYSTEM AND METHOD FOR A HYDRATION GARMENT

BACKGROUND OF THE INVENTION

1. Field of the Invention

This present invention generally relates to garments having the ability to carry water or other beverages.

Plastic water bottles are generally disposable and are widely used during both indoor and outdoor exercising activities.

Previous inventions provide a mechanism for attaching a water bottle to an exerciser in order to facilitate hands-free athletic activity. These devices alleviate the inconvenience associated with exercising while manually carrying a bottle. However, the devices often used a belt, loop, or strap to connect the bottle to the exerciser in a loose or dangling manner. When attached in such ways, water bottles often swing a great deal during athletic activities, making exercising difficult. Further, prior water bottle carriers connect to the exerciser via a belt or carrying mechanism that is often clipped to the exerciser's waistband. These devices may inadvertently and unintentionally become unattached from the user's belt with ease.

2. Description of Related Art

The prior art generally falls into two categories. The first category includes attachable water bottle carriers. The second category includes carrying devices that are not configured for holding water bottles, but are permanently affixed to an article of clothing.

The first category includes inventions that hold bottles via loops, hooks, and other bottle gripping devices. Some inventions utilize an attachment to a waistband or pocket of a pair of pants (or shortened pants) that secures a bottle by the neck through a loop or cord around the bottle. This invention is not permanently affixed to the pants. Additionally, it is typically located on either side of the wearer, over the hip, and near one of the wearer's side pocket. Other inventions are specifically for hands-free water bottle carrying. These patents utilize a device that clips onto a user's waistband or belt and provides a form-fit grip for grasping water bottles that surround approximately three-fourths of the bottle. These inventions are meant for use on the user's side or hip and also contain a stabilizing grip that surrounds the top of the water bottle. Sometimes the bottle can be attached to the user's side or hip by a keychain; this allows the bottle to dangle. Velcro™ could also be used to stick a holder to the side of a piece of exercise equipment. The water bottle is then placed in the holder that is stuck to the machine.

The other category includes clothing with permanent item holders. Some inventions include sewn in internal front pockets for storing firearms, ammunition, handcuffs, or police batons. The invention is typically designed for use by law enforcement officials. Belt loops can also be used that surround the user's waist to stabilize two sewn on, optionally permanent, tool carriers that are attached to a pair of pants and located halfway between the wearer's hip and knee. These inventions are typically for carpentry tools.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Patent Publication 2007/0083984 describes a bottle carrier attached to the pocket, belt, or waistband of a pair of pants that attaches near the cap of a bottle.

U.S. Patent Publication 2005/0109803 describes a bottle carrier that attaches to a waistband or belt via a keychain and holds a bottle just below the bottle's cap.

U.S. Pat. No. 6,004,033 describes a water receptacle that can be attached to a piece of exercise equipment through the use of Velcro.

U.S. Pat. No. 7,058,987 describes a pocket sewn into the front of a pair of trousers that can carry weapons or other equipment. It is designed for use by law enforcement officers.

U.S. Patent Publication 2008/0216212 describes carpenter pants.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicant(s) will amend the specification to expressly recite the essential material that is incorporated by reference as allowed by the applicable rules.

BRIEF SUMMARY OF THE INVENTION

The present invention provides among other things a system for a hydration support garment. The hydration support garment may be comprised of a substantially cylindrical receptacle on a rear exterior surface of the garment that may be configured to house a beverage container and may comprise a base comprised of a supportive material and an open end located distally from the base. It also may comprise an elasticized securing strap located proximally to the open end of the substantially cylindrical receptacle and configured to stabilize the beverage container when the beverage container is housed within the receptacle. The garment's base may be comprised of mesh. The garment may further comprise a storage pocket located on the garment and substantially proximal to the receptacle. The garment may further comprise an accessory for storing keys located on the garment and substantially proximal to the receptacle. The accessory may be a hook, magnet, wire, or elasticized loop.

In another embodiment, the hydration support garment may also be comprised of a substantially cylindrical receptacle on a rear exterior surface of the garment, with the receptacle being configured to house a beverage container; and a base, which may be comprised of a supportive material and an open end located distally from the base. The garment may further comprise an accessory for storing keys. The accessory may be a hook, wire, or elasticized loop.

In another embodiment, the hydration support garment may be comprised of a substantially cylindrical receptacle on a rear exterior surface of the garment, the receptacle being configured to house a beverage container and comprising a first and a second open end; the garment may also comprise a stabilizing strap coupled to an exterior side of the receptacle that traverses the first open end of the receptacle such that the stabilizing strap couples to an opposite exterior side of the receptacle. This embodiment may also comprise a storage pocket. This embodiment may also comprise an accessory for storing keys. The accessory could be a hook, wire, or elasticized loop.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. The full scope of the inventions is not limited to the examples that are described below.

Figure 1:
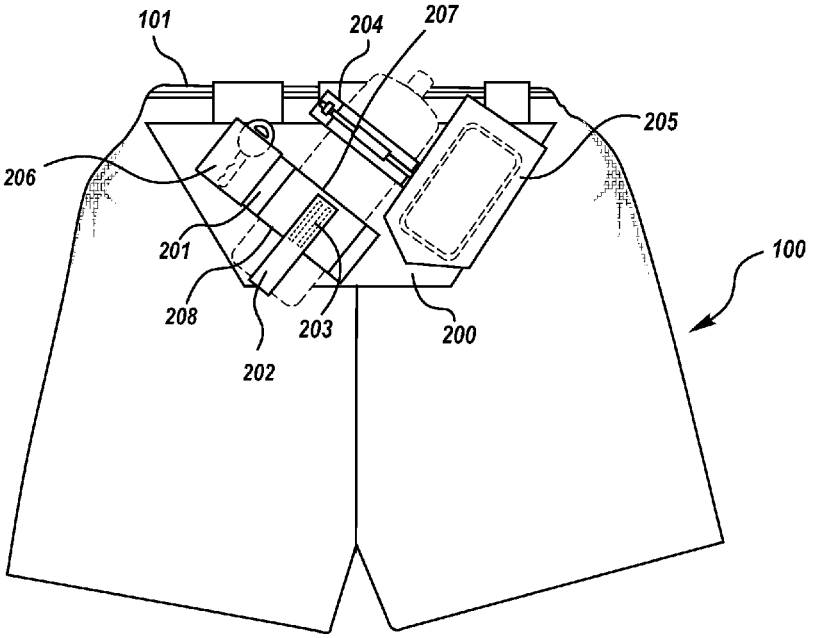
FIGS. 1-6 depict a rear view of the hydration garment according to various embodiments of the invention.

FIG. 1 shows one embodiment of the invention. In it, a neoprene patch 200 may be sewn onto the back of a pair of commercially available or other athletic shorts 100. Pants or skirts can also be used in lieu of athletic shorts 100. The patch 200 may contain a substantially cylindrical receptacle 201 that may be sewn on the rear of the athletic pants, shorts, a skirt or other garment such that the substantially cylindrical receptacle may extend away from the user's body. The patch 200 may be located on the posterior of the athletic shorts 100 or other garment. The substantially cylindrical receptacle 201 may be comprised of a first open end 207 and a second open end 208. The substantially cylindrical receptacle 201 may also include a stabilizing strap 202 that is coupled to one exterior side of the substantially cylindrical receptacle 201, runs across second open end 208 of the receptacle, and attaches to the opposite exterior side of the second open end 208 of the substantially cylindrical receptacle. The mechanism of attachment may include a hook and loop fastener, such as Velcro™ or a clipping device 203 or another similar mechanism. The first open end 207 may be located distally from the end that the stabilizing strap 202 runs across. Additionally, the invention may comprise an elastic securing strap 204 that is also sewn to the neoprene attachment. The elastic securing strap 204 is located above the first open end 207 of the substantially cylindrical receptacle 201 and is used to secure the water bottle when it is placed in the substantially cylindrical receptacle 201. The elastic securing strap 204 may also be made of plastic or any other similar material. This application of the invention may also optionally comprise a pocket 205 sewn into the neoprene patch 200. The pocket 205 can store a cellular telephone, energy gel, a compass, or any other device the user wants. The invention may also comprise a key-storing accessory 206 that may be comprised of wire, magnets, a hook, or a loop, or both. This accessory 206 may be used to store house or car keys. The cylindrical receptacle 201, elastic securing strap 202, elastic strap 204, pocket 205, and accessory 206 may all be angled with respect to the neoprene belt loop 101.

Figure 2:
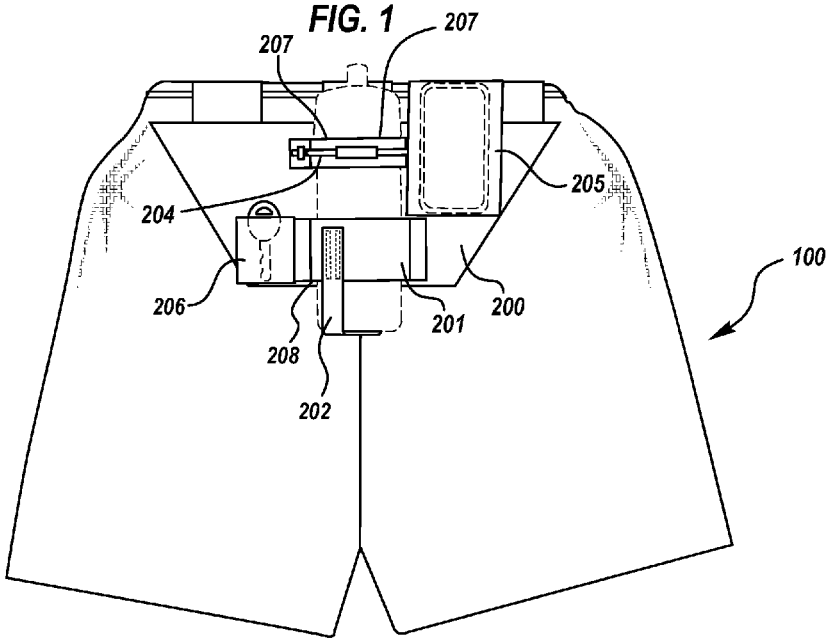

FIG. 2 shows an alternative embodiment to the invention. As shown, the cylindrical receptacle 201, stabilizing strap 202, elastic securing strap 204, pocket 205, and accessory 206 may be coupled to the neoprene patch 200 perpendicularly with respect to the neoprene belt loop 101. This embodiment still includes a first open end 207 and a second open end 208. This embodiment may be more comfortable than FIG. 1's embodiment to users with certain body shapes or running styles.

Figure 3:
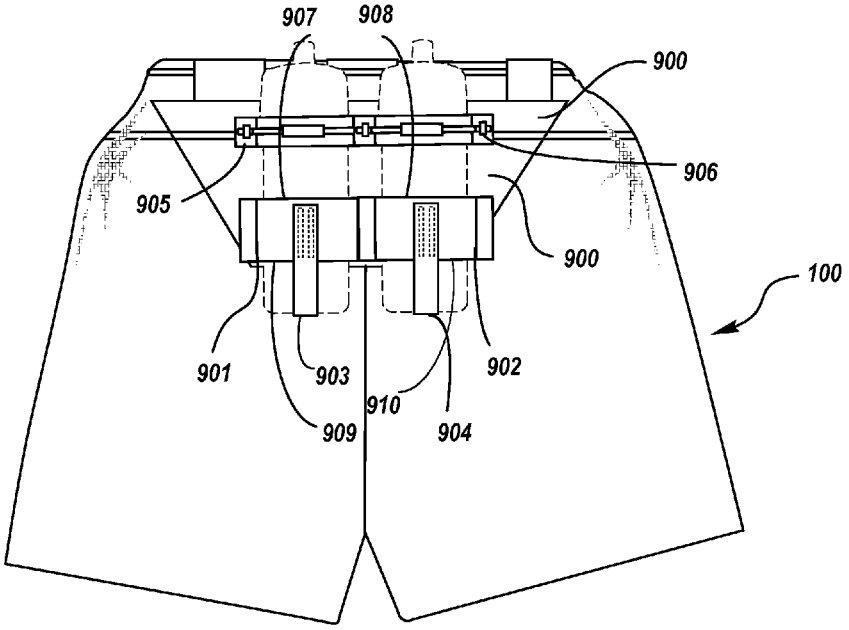

FIG. 3 shows an alternative embodiment to the invention. In FIG. 3, there is no pocket for a phone or other items, nor is there an attachment for keys. Instead, there may be at least two water bottle holders coupled to the neoprene patch 900. FIG. 3 shows a first water bottle holder has both a first open end 907 and a second open end 909. The first water bottle holder may be comprised of a first cylindrical receptacle 901, a first stabilizing strap 903, and a first elastic securing strap 905. FIG. 3 also shows a second water bottle holder that may also have both a first open end 908 and a second open end 910. The second water bottle holder may be comprised of a second cylindrical receptacle 902, a second stabilizing strap 904, and a second elastic securing strap 906. This embodiment is particularly helpful if the user plans on going on extended exercise excursions.

Figure 4:
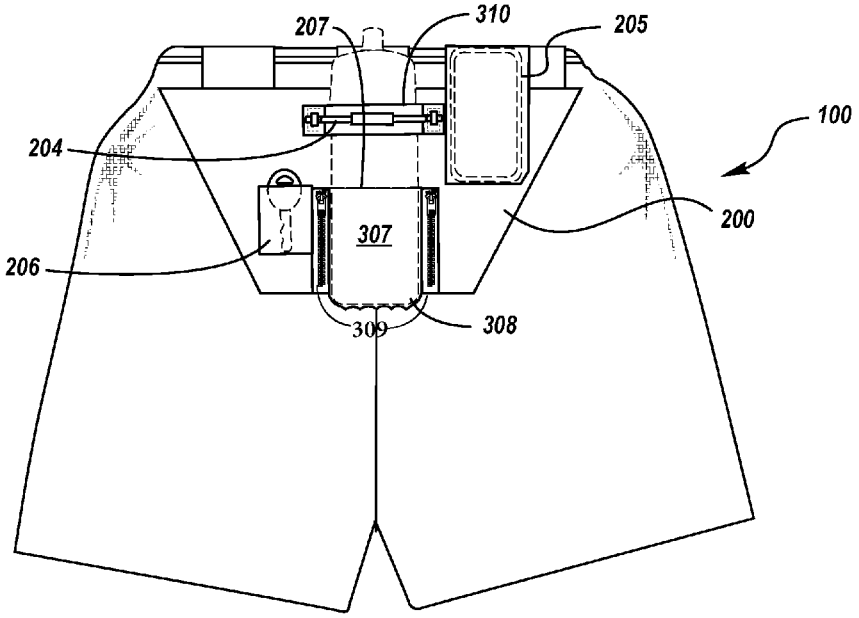

FIG. 4 shows an alternative embodiment to the invention. The invention still includes an elastic securing strap 204, a pocket 205, and an accessory for keys 206. It is still designed to secure a water bottle to a pair of athletic shorts. However, in this embodiment, the cylindrical receptacle 307 may be comprised of both an open end 207 and a base 308. The base 308 is made of mesh, or other similarly supportive materials. The open end 207 is located distally from the base 308. The receptacle may be attached to the neoprene pouch by zippers 309.

Figure 5:
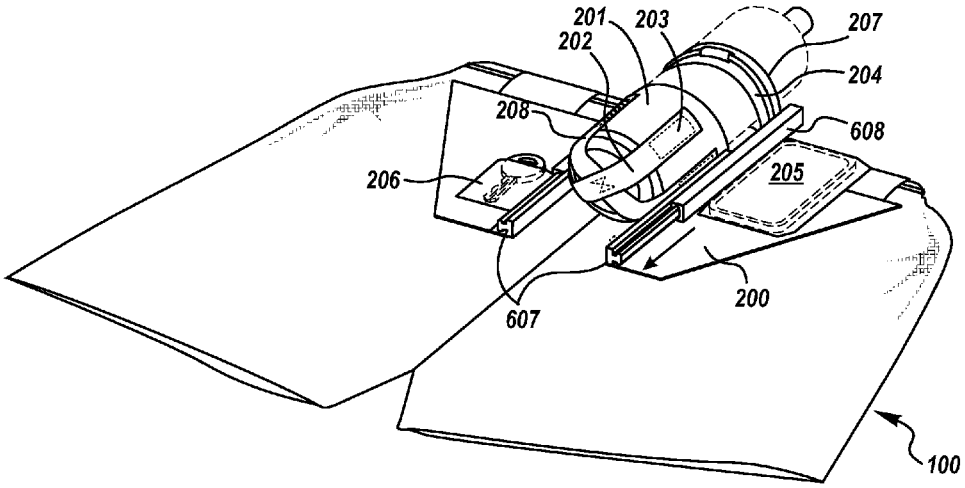
Figure 6:
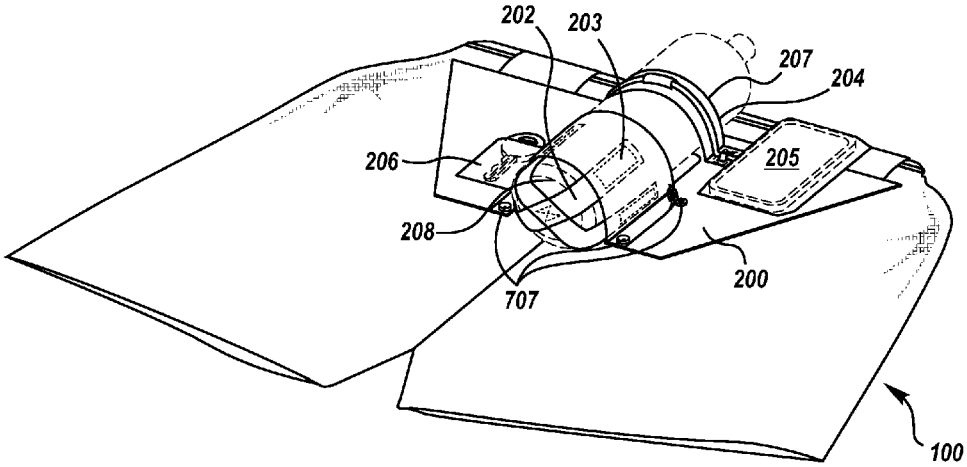

FIGS. 5 and 6 show two other alternative embodiments to the invention. Both embodiments may include an elastic securing strap 204, a pocket 205, and an accessory for keys 206. In FIG. 5's embodiment, however, the mechanism by which the cylindrical receptacle 201 may connect to the neoprene patch 200 is by a detachable tongue 608 and groove 607 holster. The one or more tongues 608 may be attached to the cylindrical receptacle 201 by a hook and loop fastener such as Velcro™ or a similar mechanism and allow for the cylindrical receptacle 201 to slide into the grooves 607, which form a track, and firmly attach to the neoprene patch 200. The tongues 608 may slide into the groove 607 of the holster either vertically, horizontally, or at an angle with respect to the user. The tongue and groove holster may work by allowing the tongue 608 to be shaped such that it will slide into the groove 607 and create a secured placement of the cylindrical receptacle 201 within the holster when the tongue 608 reaches an end of the groove 607 along the track. The tongues 608 may couple to the groove 607 holster either by a specially shaped piece at the end of the holster's track, magnets, a tying mechanism, or by any other appropriate fastener. The end of the holster's track may be placed so that it is closer to the waistband of the shorts, pants or skirt than it is to the bottom of the garment, or so it is closer to the bottom of the garment than it is to the garment's waistband. The tongues 608 and grooves 607 may be made out of plastic, wood, lightweight metals, or any other similar materials.

FIG. 6 also shows an embodiment by which the mechanism of attaching the cylindrical receptacle 201 to the neoprene patch 200 may differ. Instead of using a detachable tongue 608 and groove 607, as displayed in FIG. 5, a set of detachable snaps 707 can be used. The snaps 707 may be attached to the outside of the cylindrical receptacle and have corresponding clasps located below snaps 707 that allow the cylindrical receptacle to be buttoned, or "snapped," securely into the neoprene patch 200.

I claim:

1. A hydration support garment comprising:

a substantially cylindrical receptacle attached to an elasticized coupling patch that is attached on a rear exterior surface of a lower-body garment configured to house a beverage container and comprising a base comprised of a supportive material and an open end located distally from the base;

wherein the receptacle is configured at an acute angle relative to a waistband of the garment and the base further comprises a first strap and a receptacle strap perpendicularly intersecting one another; and an elasticizing securing strap located proximally to the open end of the substantially cylindrical receptacle configured to stabilize the beverage container when the beverage container is housed within the receptacle.

2. The hydration support garment of claim 1, wherein the base is comprised of mesh.

3. The hydration support garment of claim 1, further comprising a storage pocket located on the garment and substantially proximal to the receptacle.

4. The hydration support garment of claim 1, further comprising an accessory for storing keys located on the garment and substantially proximal to the receptacle.

5. The hydration support garment of claim 4 wherein the accessory is a hook.

6. The hydration support garment of claim 4 wherein the accessory comprises at least one of a magnet, a wire, and an elasticized loop.

7. The hydration support garment of claim 4 wherein the accessory is a pocket.

8. A hydration support garment comprising:

a substantially cylindrical receptacle attached to an elasticized coupling patch that is attached on a rear exterior surface of a lower-body garment, the receptacle configured to house a beverage container and comprising a base comprised of a supportive material and an open end located distally from the base, the base further comprising a first strap and a receptacle strap perpendicularly intersecting one another; and wherein the receptacle is configured at an acute angle relative to a waistband of the garment.

9. The hydration support garment of claim 8 further comprising a storage pocket.

10. The hydration support garment of claim 8 further comprising an accessory for storing keys.

11. The hydration support garment of claim 10 wherein said accessory comprises at least one of a hook, a wire, and an elasticized loop.

12. The hydration support garment of claim 10 wherein said accessory is a pocket.

13. A hydration support garment comprising:

a substantially cylindrical receptacle attached to an elasticized coupling patch that is attached on a rear exterior surface of a lower-body garment, the receptacle configured to house a beverage container and comprising a first and a second open end;

wherein the receptacle further comprises a stabilizing strap and a receptacle strap perpendicularly intersecting one another and the receptacle is configured at an acute angle relative to a waistband of the garment;

the stabilizing strap coupled to an exterior side of the receptacle and traversing the first open end of the receptacle such that the stabilizing strap couples to an opposite exterior side of the receptacle; and a securing strap located proximally to the open end of the substantially cylindrical receptacle.

14. The hydration support garment of claim 13 further comprising a storage pocket.

15. The hydration support garment of claim 13 further comprising an accessory for storing keys.

16. The hydration support garment of claim 15 wherein said accessory comprises at least one of a hook, a wire, and an elasticized loop.

17. The hydration support garment of claim 15 wherein said accessory is pocket.

18. The hydration support garment of claim 1, wherein the garment is a skirt, a pair of pants, or a pair of shorts.

19. The hydration support garment of claim 8, wherein the garment is a skirt, a pair of pants, or a pair of shorts.

20. The hydration support garment of claim 13, wherein the garment is a skirt, a pair of pants, or a pair of shorts.

* * * * *